US008746673B1

(12) United States Patent
Nickerson et al.

(10) Patent No.: US 8,746,673 B1
(45) Date of Patent: Jun. 10, 2014

(54) ADJUSTMENT OF MEDIA PICK PARAMETER

(71) Applicant: Hewlett-Packard Development Company, L.P., Houston, TX (US)

(72) Inventors: Michael Nickerson, Boise, ID (US); Richard L. Payne, Boise, ID (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/752,497

(22) Filed: Jan. 29, 2013

(51) Int. Cl.
*B65H 5/00* (2006.01)

(52) U.S. Cl.
USPC ..... 271/10.02; 271/10.03; 271/258.01; 271/265.01

(58) Field of Classification Search
USPC ..... 271/9.01, 9.03, 10.01, 10.02, 10.03, 271/258.01, 265.01; 399/8, 18, 23
See application file for complete search history.

(56) References Cited

U.S. PATENT DOCUMENTS 6,032,944 A 3/2000 Lee
6,574,569 B1 * 6/2003 Omata et al. ..... 702/33
6,952,536 B2 * 10/2005 Soar et al. ..... 399/16
7,584,951 B2 * 9/2009 Otani et al. ..... 271/10.01
7,934,722 B2 * 5/2011 Namikawa ..... 271/265.04
2005/0141944 A1 6/2005 Lee et al.
2009/0008861 A1 * 1/2009 Kasahara et al. ..... 271/10.03
2009/0034993 A1 2/2009 Son et al.
2010/0117289 A1 * 5/2010 Takahashi et al. ..... 271/9.01
2011/0292434 A1 12/2011 Lim et al.
2012/0139179 A1 * 6/2012 Blair et al. ..... 271/10.01

FOREIGN PATENT DOCUMENTS

JP 2006335545 A 12/2006

OTHER PUBLICATIONS

Bukkems, B. et al., "A Piecewise Linear Approach Towards Sheet Control in a Printer Paper Path", Proceedings of the 2006 American Control Conference Minneapolis, Minnesota, USA, Jun. 14-16, 2006, http://ieeexplore.ieee.org/stamp/stamp.jsp?arnumber=1656399, Jun. 2006, pp. 1315-1320.

* cited by examiner

*Primary Examiner* — David H Bollinger

(57) ABSTRACT

A system includes a media path along which physical media travels. A media pick device picks and transports the media in the media path according to one or more pick parameters. A device monitor can monitor a media pick or jam event and provide a media pick event output. The media pick event output identifies a media fault relating to at least one of the pick or the transport of the media. A controller processes the media pick event output to control the media pick device.

19 Claims, 6 Drawing Sheets

ADJUSTMENT OF MEDIA PICK PARAMETER

BACKGROUND

Peripheral devices, such as printers, faxes, scanners and/or copiers, utilize many components to control how media (e.g., paper) is picked and guided though the devices during a printing, copying, scanning, or faxing process. Such components can include a feed system having rollers to initially pick and guide the media toward an image transfer zone where a print head applies ink or toner is applied to the media, or where data is scanned from the media. Various hardware such as rollers, pads and guides for picking and moving media in the printer or other media processer can serve different functions. A peripheral device can also include some type of pick device to select and transport the media during a given process. Jams commonly occur at the beginning of the paper path or at the pick stage in the pick device.

DETAILED DESCRIPTION

A system and method is provided that enables automated media pick and transport adjustments to improve success of pick and transport of media through a media path, such as in printers, copiers, fax machines, and scanners, for example. A media pick device can select media such as paper, for example, and transport the paper further through the media path, such as a printing process, for example. A device monitor receives data describing media pick events from the media pick device. The media pick event may include a paper jam that has been detected, for example. The media pick event may also include cases that picked successfully, but with longer pick time or slower paper movement. These cases of degradation can be considered media pick events that are early warnings to future pick failures.

A controller processes the media pick events in view of a predetermined threshold. In one example, the threshold can be related to a frequency of faulted pick events such as how often has a paper jam occurred in the media pick device. If the number of pick events, combinations of pick events, patterns of pick events (or other criteria such as environment or media type) exceed the predetermined threshold, the controller automatically adjusts one or more pick parameters in the media pick device to mitigate further pick events from occurring.

The pick parameters could include prompting the user to install different parts to improve pick performance in the given situation. The system can track any number of jam or mispick event statistics along with environmental variables such as temperature, humidity, engine or component life, media type specified or detected, and so forth. Based on analysis of such data performed either on the machine itself, or remotely, changes to pick parameters can automatically occur and/or new hardware shipped that will improve performance.

Remote processing can also be available. For example, the media pick event data can be communicated to one or more remote locations if the media pick events exceed the threshold. Based on such communications, replacement components can be shipped to enable manual adjustment of the pick parameters for the media pick device. The controller can also include learning components that monitor conditions over time. The learning component can instruct the controller to adjust the pick parameter for one given set of conditions and adjust the pick parameter (or parameters) to another setting as conditions change.

Figure 1:
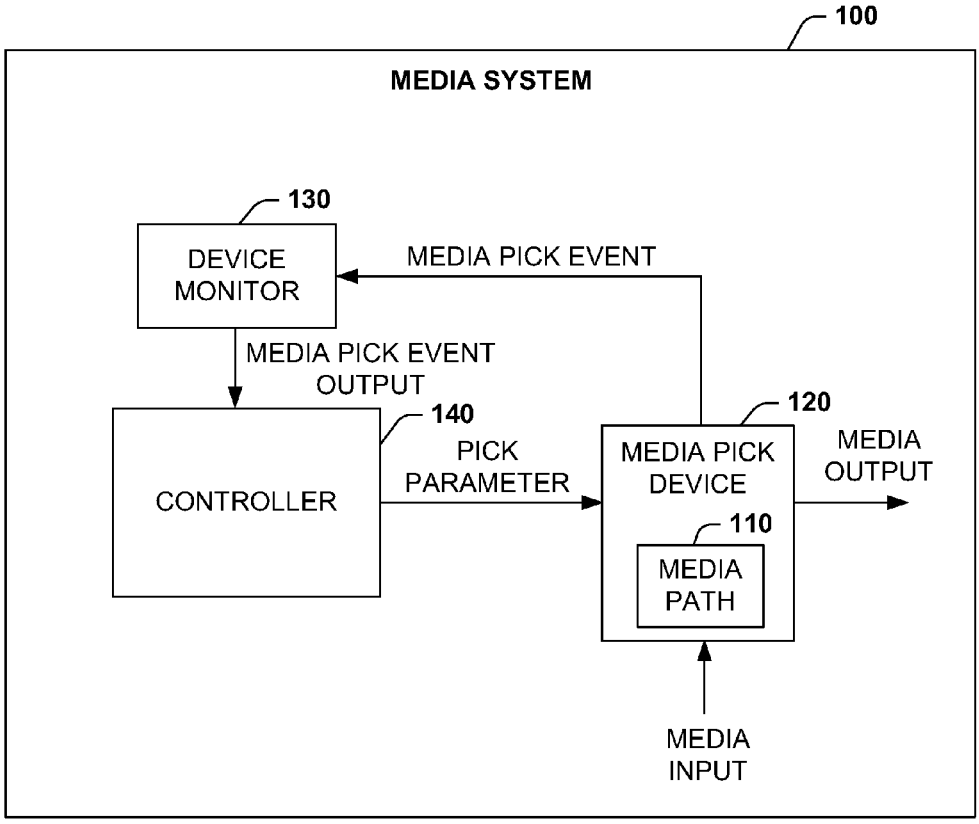
FIG. 1 illustrates an example system that monitors faults in a media system and adjusts parameters to control a media selection and transport device based on such monitoring.

FIG. 1 illustrates an example of a system 100 to monitor faults in a media path 110 and adjust one or more parameters to control a media pick and transport device based on such monitoring. The media path 110 can be located in between where media is input to a media pick device 120 and where the media exits the device as media output. As used herein, the media path 110 can reside in any media system, such as a printer, copier, scanner or a multi-function device through which media travels, for producing or extracting a representation of an electronic document. The media system 100 can employ the media pick device 120 to guide the media along the media path 110, for example. For example, one or more components along the media path 110 can be configured to produce a representation of data on to physical media as it traverses the media path. Such data can include substantially any type of content including characters, images, symbols, and so forth. The media pick device 120 picks and transports the media in the media path 110. As used herein, the term pick is related to the selection of a single piece of tangible media from a stack of such media (e.g., paper, transparency film or the like).

In the example of FIG. 1, the media pick device 120 picks media input such as from a paper stack, for example, and generates media output for a later point in the process such as printing, for example. A device monitor 130 can monitor the media pick events. For example, the media pick events can include statistics that identify a media fault condition relating to one or more of the pick and transport of the media in the media pick device 120. This can also include events where the media was picked but from an analysis of media and roller movement, for example, increased slip was detected during the event which could also lead to parameter adjustment or notification of such. A controller 140 can be configured to process the media pick events from the device monitor 130 in view of a predetermined threshold. For example, the controller 140 can be configured to adjust a pick parameter (or multiple pick parameters) to control the media pick device 120 with respect to the pick and transport of the media if the media events are detected above the predetermined threshold.

In some common examples, the media path 110 can include a transport path in a printer, a copier, a fax machine, or a scanner; however, the media path can be implemented in substantially any device that selects and/or transports media. The media path 110 can accommodate media having a variable thickness. The media can include at least one of paper, plastic, polymer, synthetic material, and vellum, for example.

As a further example, the media pick events can include at least one fault type associated with the selection and/or transport of the media through the media path. Such fault types for a media pick event can include a no-pick jam where no media is selected by the media pick device during a pick event or a multi-pick jam where more than a single sheet of media is selected by the media pick device. Another fault type example can include a skew jam where media is improperly oriented by the media pick device or a fuser wrap jam where a fuser wrap component (e.g., of a laser printer) malfunctions in the media pick device 120. Still other fault type examples include an exit jam where a transport stoppage occurs at the output of the media pick device 120 (or media system) or a late to register jam (or fail to register jam) where the media is improperly registered by the media pick device.

In one example, the controller 140 can adjust the pick parameter based on a predetermined type for media pick events, such as the fault type examples described herein. For example, if a skew jam fault were to occur, this fault type by itself could trigger an adjustment in the pick parameter. In another example, the controller 140 adjusts the pick parameter based on a frequency of media pick events being above the predetermined frequency threshold. In yet another example, the controller adjusts the pick parameter based on a predetermined pattern of media pick events, wherein the predetermined pattern is defined as multiple types of pick events. This can include combinations of pick events and other types of jams, or combinations that also include environmental conditions such as temperature, humidity, media type detection or selection, and so forth occurring at a rate above a predetermined threshold set for the predetermined pattern.

The pick parameter can include at least one of a stack lift height which relates to the height of the media stack, a stack pressure relating to a pressure reading from the stack, a pick roller stutter pattern relating to how the rollers are oriented toward one another, a pick roller pressure relating to how much pressure is between the rollers, a timing parameter relating to how quickly the media is guided, a torque pattern for the roller shaft, a motor parameter (e.g., acceleration setting), and a feedback parameter (e.g., encoder setting), for example. The pick parameter can also include the coefficient of friction of the roller that can be changed by changing rollers. Alternate pick/feed roller hardware with unique designs and pick pick/feed properties, or simply new pick/feed roller hardware can also be recommended.

In one specific example of the media system 100, a media type sensor can detects heavy media (e.g., glossy media) and another sensor detects that pick timing seems to be off. Yet another sensor may detect that humidity is high and rising. The controller 140 can determine that the current rollers have 1 jam in 10 pages with normal settings which is deemed unacceptable. With increased pressure and advanced pick routines, the controller 140 has observed 1 jam in 100 pages in the past. However, if the pick rollers were changed to a stickier compound on the rollers, 1 jam in 1000 pages should be achievable. The controller 140 can inform the user that different rollers would be optimal, but can also keep trying with the advanced control routines until the rollers are changed. As the humidity keeps rising, the need for the special rollers may increase, for example.

In another example, some papers are very light and have a high calcium carbonate content. The calcium carbonate can easily flake off and quickly contaminate the rollers so that they no longer grip the paper as well as they did when new. When the controller 140 observes increasing cases of partially-picked or unpicked paper, it can recommend new rollers and/or cleaning of the current rollers, for example.

In some examples, as will be described with respect to the example of FIG. 2 below, a communications device operative with the controller 140 can communicate media events to a remote location from the system 100. In response to the communication of such media events, replacement components having a different pick parameter, or replacement components that are new (e.g., not worn out or contaminated) can be ordered and shipped to a user for replacing one or more media components along the media path 110. The replacement components thus can provide a mechanism for making a manual adjustment for the media pick device 120. In a hybrid control example, automated parameter adjustments can be initiated by the controller 140 in addition to manual replacement components that may have been ordered. In another example that will be described below with respect to FIG. 3, the controller 140 can include a learning component that monitors the media events from the device monitor 130 over time and enables the controller to adjust the pick parameter(s) depending on a detected range of conditions (e.g., on parameter setting for temperature 1, and another parameter setting for temperature 2).

The system 100 provides for automatic monitoring of pick results and automatic adjustment (and/or manual adjustment) of pick parameters based on one or more of the frequency, patterns, and types of mispick jams or timing degradation detected by the device monitor 130. The system 100 can utilize an analysis of machine-collected mispick data to automatically adjust a variety of pick settings to avoid mispick jams such as no-picks, multi-picks, and skew to name but a few examples. The system 100 can monitor a variety of mispick events via the device monitor 130 which can include digital inputs, analog inputs, or a combination of digital and analog inputs for monitoring. If the monitored events exceed certain predefined thresholds such as frequency, or match certain pre-defined patterns, or match certain pre-defined types, or any match predefined combinations of the same, the controller 140 can automatically change relevant pick parameters or suggest/order alternative or new pick/feed roller hardware sets. For example, the controller 140 can adjust parameters, such as stack lift height, stack pressure, pick roller stutter patterns, pick roller pressure, timing, torque patterns, and a variety of other parameter examples that can be used to tune pick performance to mitigate further jams. This allows the system 100 to successfully feed a wider variety of media through the media path 110, resulting in improved pick performance, reduced warranty costs and increased user satisfaction.

Figure 2:
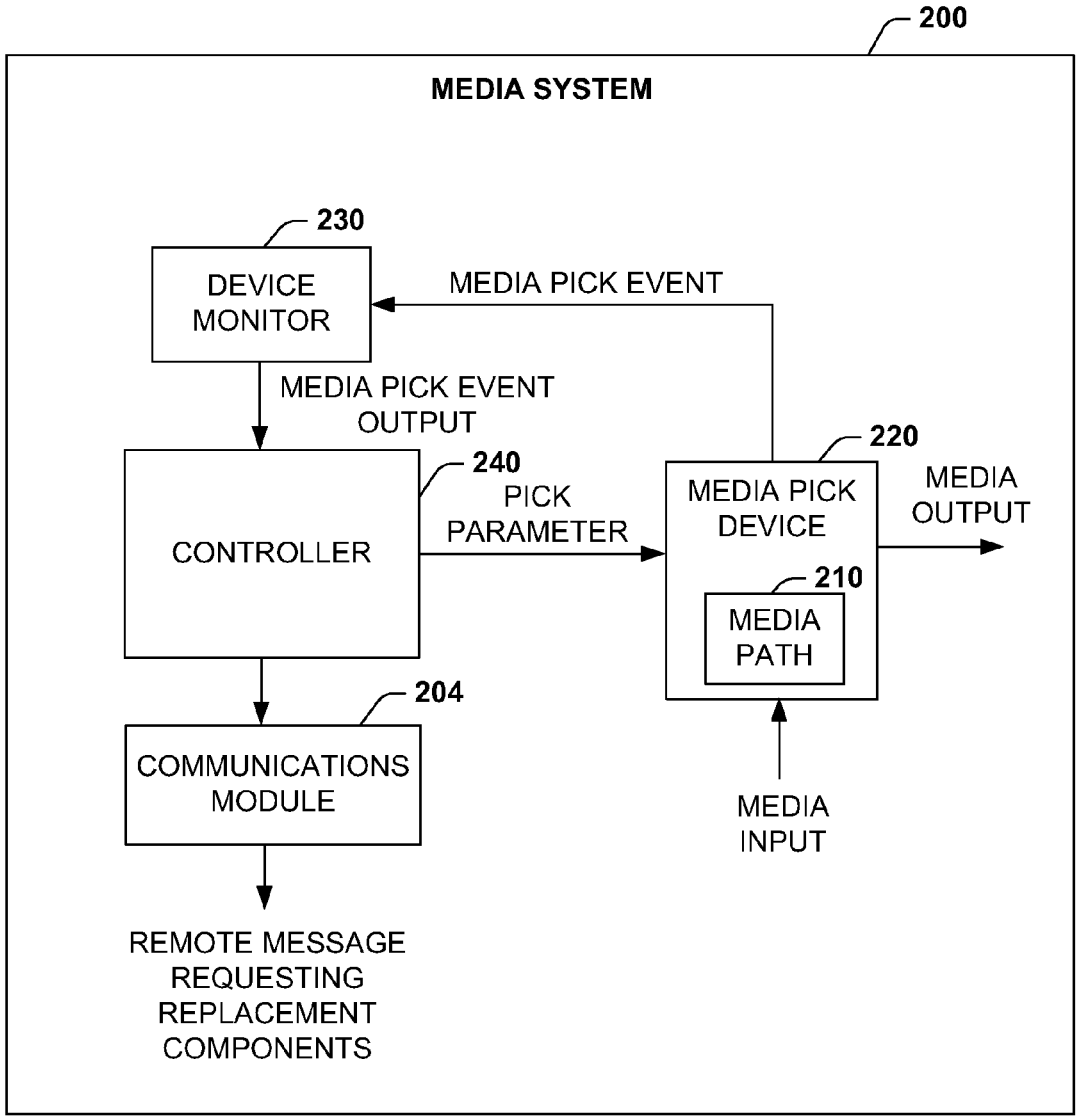
FIG. 2 illustrates an example system having a communications module that monitors faults in a media system and adjusts parameters to control a media selection and transport device based on such monitoring.

FIG. 2 illustrates an example media system 200 having a communications module 204 that monitors faults in a media path 210 and adjusts parameters to control a media pick and transport device based on such monitoring. Similar to the system 100 described herein, the system 200 includes a media path 210 through which physical media can travel, such as for a applying a representation of data to the media or extracting information from the media. A media pick device 220 picks and transports the media in the media path 210. A device monitor 230 can be programmed to monitor media pick events, wherein the media pick events identify a media fault relating to the pick and transport of the media in the media pick device 220. A controller 240 processes the media pick events from the device monitor 230 in view of a predetermined threshold. The controller 240 can adjust a pick parameter to control the media pick device 220 with respect to the pick and transport of the media if the number of media events detected exceeds the predetermined threshold.

In addition to automated adjustments, the system 200 can facilitate manual replacement of components in the media pick device 220 or the media path 210. The communications module 204 is operative with the controller 240 to communicate media events to a remote location from the media system 200 (e.g., via Internet message to a manufacturer of the media system). The replacement components provide different pick parameters and can be shipped to provide a manual adjustment for the media pick device 220 and/or media system 200. In one example, the need for a different roller set can be detected, then recommended and installed to manually adjust the pick parameters in the media pick device 220. As described above, in some examples, the controller 240 can initiate automated parameter adjust in the media pick device 220 and/or can also generate a remote message for new replacement parts via the communications module 204.

Figure 3:
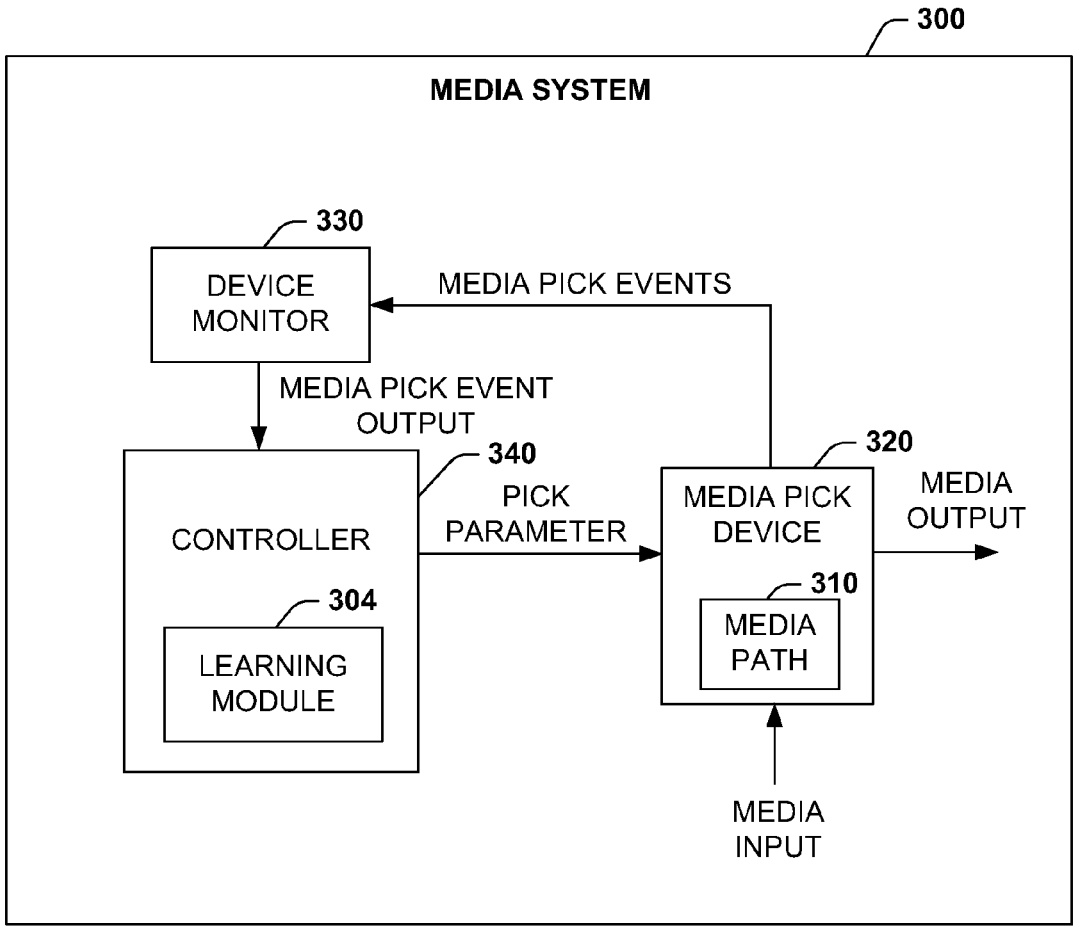
FIG. 3 illustrates an example system having a learning module that monitors faults in a media system and adjusts parameters to control a media selection and transport device based on such monitoring.

FIG. 3 illustrates an example system 300 having a learning module 304 that monitors faults in a media processor and adjusts parameters to control a media pick and transport device based on such monitoring. Similar to the system 100 and 200 described herein, the system 300 includes a media path 310 through which physical media travels, such as for applying data to the media (e.g., in a printer or copier) and/or for extracting data from the media (e.g., in a scanner or copier). A media pick device 320 picks and transports the media in the media path 310. A device monitor 330 can monitor media pick events and provide an output to identify a media fault condition relating to the pick and/or transport of the media in the media pick device 320. A controller 340 processes the media pick event output from the device monitor 330 relative to a predetermined threshold. The controller 340 can adjust a pick parameter to control the media pick device 320 with respect to the pick and/or transport of the media if the media events are detected above the predetermined fault threshold.

The learning module 304 monitors the media event output from the device monitor 330 over time and, based on an aggregate set of the monitored media events, enables the controller 340 to adjust the pick parameter depending on a detected range of conditions. The media events can include a number of one or more different conditions, such as temperature, humidity, a number of no-pick events, different media types, skews, mispicks, timing degradation, different combinations of events, and so forth. For example, the learning module 304 can determine that, at a given temperature range and based on jam analysis (type, frequency) media type specified or detected, one set of pick parameters ought to be employed whereas at a different temperature range, a different set of pick parameters should be employed in view of the detected range. The learning module 304 can be trained to monitor for various conditions and/or patterns. For example, the learning module 304 may detect that only after a given sequence of media processor operations that a media jam occurs. Such condition may also be triggered when differing media thicknesses and/or media types selected, wherein the learning module 304 can adjust the pick parameter set to compensate for such detected conditions, media types, or other monitored variable in the media system 200. Substantially any type of learning module 304 can be employed in the controller 340. In one example, a classifier (e.g., support vector machine) can be employed as the learning module 304 but other types can be employed as well. As a further example, if paper requires increased motor rotations in order to start paper moving at a fixed speed, the learning module 304 can conclude that the rollers are becoming contaminated and request that the rollers be cleaned through the communications module 204 described above.

Figure 4:
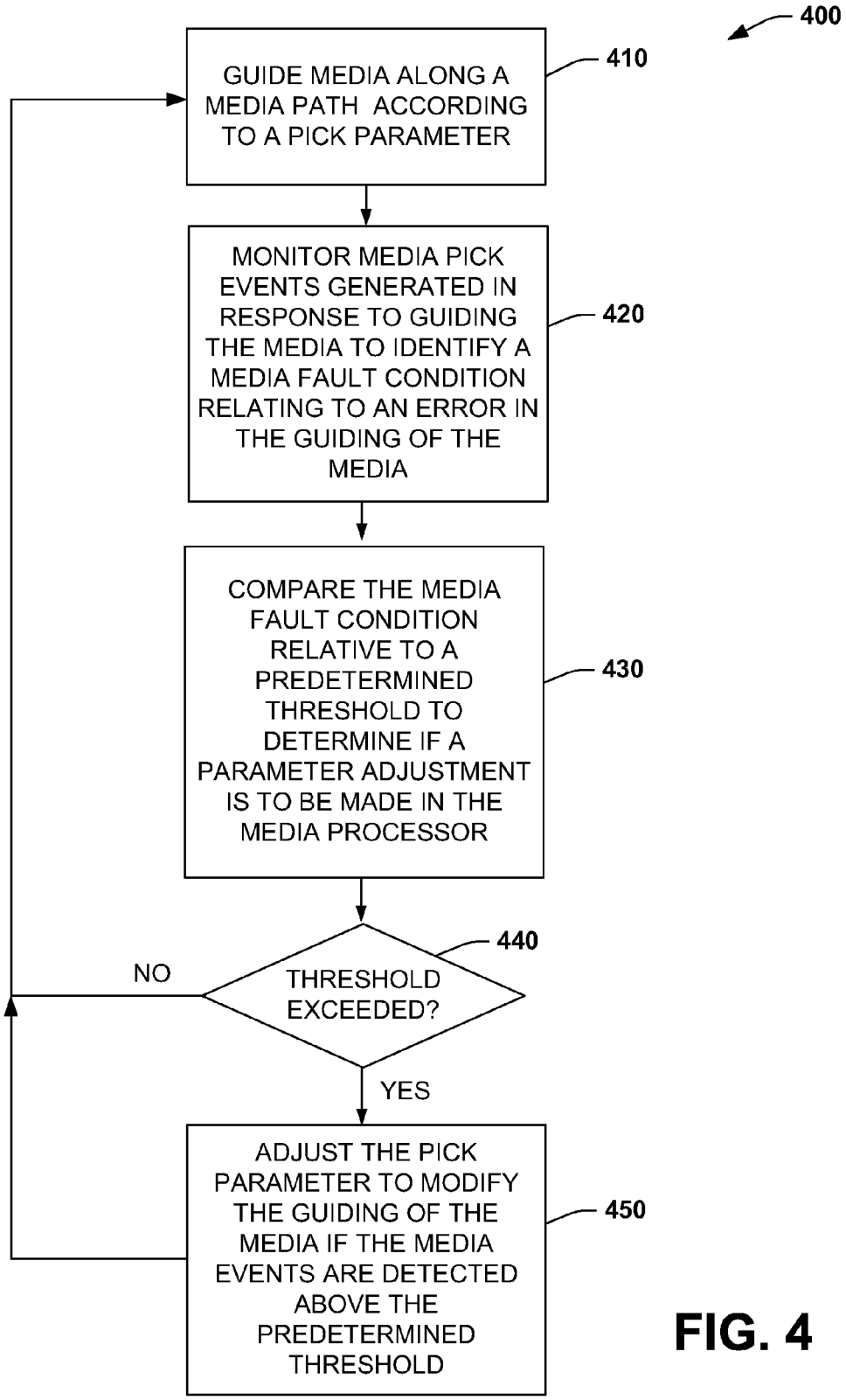
FIG. 4 illustrates an example method to control a media selection and transport device based on monitoring.
Figure 5:
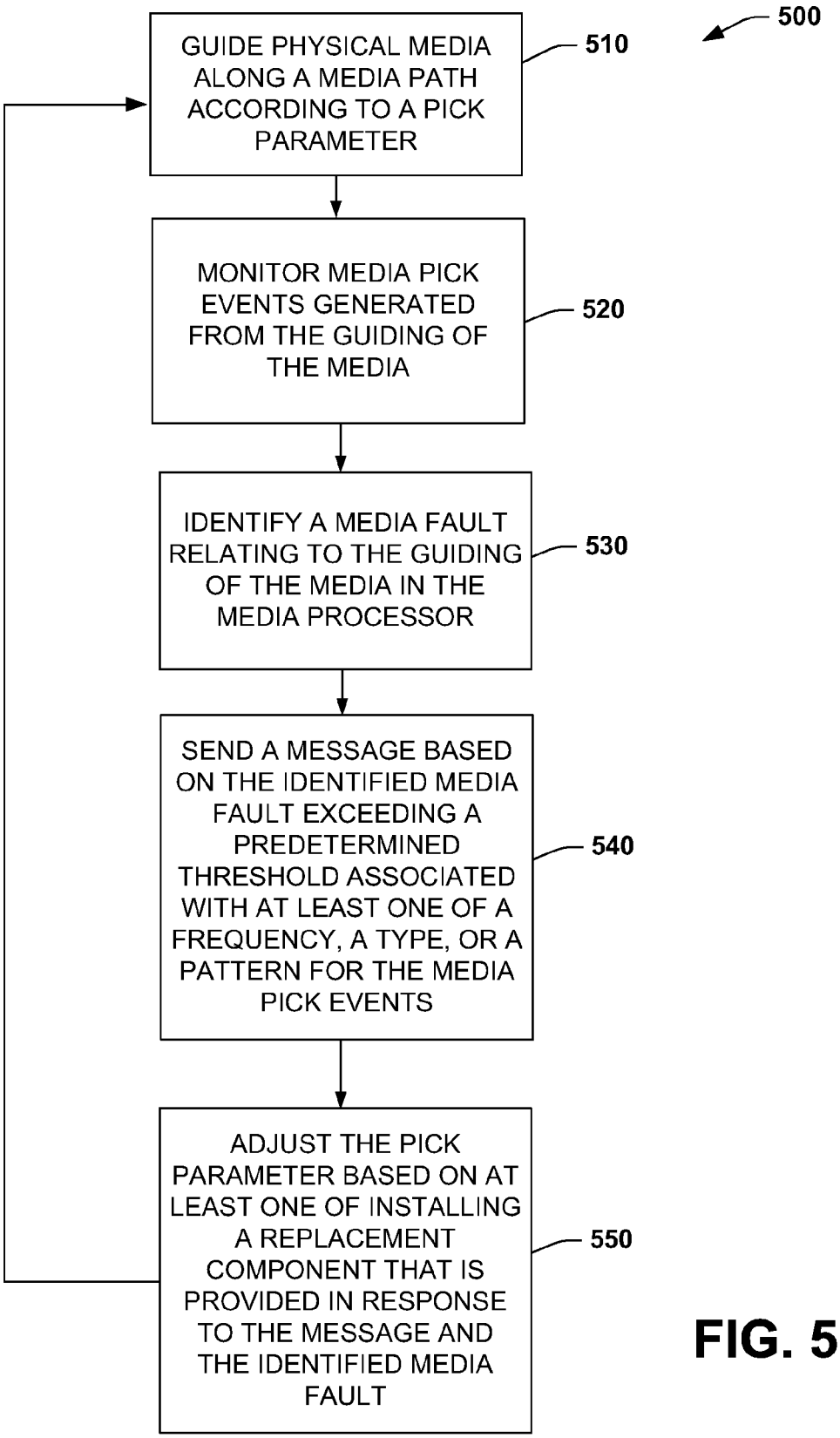
FIG. 5 illustrates an example method to control a media selection and transport device based on monitoring and remote communications.

In view of the foregoing structural and functional features described above, example methods will be better appreciated with reference to FIGS. 4 and 5. While, for purposes of simplicity of explanation, the example methods are shown and described as executing serially, it is to be understood and appreciated that the present examples are not limited by the illustrated order, as some actions could in other examples occur in different orders and/or concurrently from that shown and described herein. Moreover, it is not necessary that all described actions be performed to implement the methods described herein. The example methods of FIGS. 4 and 5 can be implemented as machine-readable instructions for a controller that can be stored in a non-transitory computer readable medium, such as can be computer program product or other form of memory storage. The computer readable instructions corresponding to the methods of FIGS. 4 and 5 can also be accessed from memory and be executed by a processor.

FIG. 4 illustrates an example method 400 to control a media pick and transport device based on monitoring. At 410, the method 400 includes guiding media along a media path of a peripheral device (e.g., via media pick device 120 of FIG. 1). At 420, the method 400 includes monitoring media pick events generated in response to guiding the media to identify a media fault condition relating to an error in the guiding of the media. The monitoring of media pick events can identify a media fault relating to the guiding of the media in the media path (e.g., via device monitor 130 of FIG. 1). At 430, the method 400 includes comparing the media fault condition relative to a predetermined threshold to determine if a parameter adjustment is to be made (e.g., via controller 140 of FIG. 1).

At 440, the method 400 includes a determination as to whether or not the predetermined threshold was exceeded. If the predetermined threshold was not exceeded at 440, the method proceeds back to 410 to guide another piece of media. If the predetermined threshold was exceeded at 440, the method 400 proceeds to 450. At 450, the method 400 includes adjusting the pick parameter. The pick parameter can be adjusted to control the guiding of the media to mitigate further media pick fault conditions. In another example, the method 400 can include automatically adjusting the pick parameter based on a predetermined type or a predetermined pattern for the media pick events. This can also include adjusting the pick parameter based on a frequency of media pick events being above the predetermined frequency threshold.

FIG. 5 illustrates an example method 500 to control a media pick and transport device based on monitoring and remote communications. At 510, the method 500 includes guiding media along a path in a media path (e.g., via media pick device 120 of FIG. 1). At 520, the method 500 includes monitoring media pick events generated from guiding the media, wherein the media pick events identify a media fault relating to the guiding of the media in the media path (e.g., via device monitor 130 of FIG. 1). At 530, the method 500 includes identifying a media fault relating to the guiding of the media (e.g., via media pick device 120 of FIG. 1). At 540, the method 500 includes sending an automated message based on exceeding a predetermined threshold associated with a frequency, a type, or a pattern for the media pick events, or a predetermined combination of events (e.g., via controller 140 of FIG. 1). At 550, the method 500 includes adjusting the pick parameter based on at least one of installing a replacement component, or cleaning existing components that is provided in response to the message and the identified media fault. Replacement components can include differing rollers to guide the media in the media processor, for example. After component replacement, the method 500 proceeds back to 510 to guide additional media.

Figure 6:
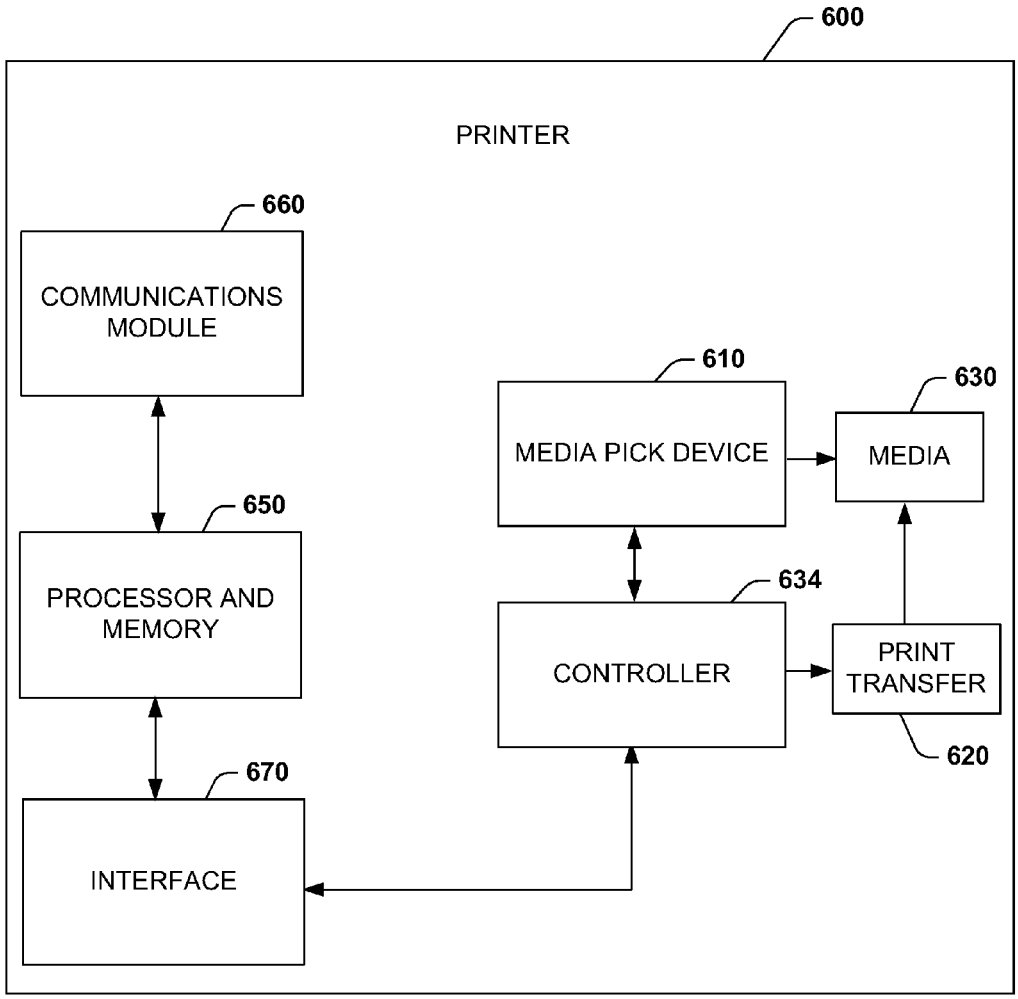
FIG. 6 illustrates an example printer that monitors faults and adjusts parameters to control a media pick device based on such monitoring.

FIG. 6 illustrates an example printer 600 that monitors faults and adjusts parameters to control a media pick device 610 based on such monitoring. The printer 600 includes a print transfer apparatus 620 to transfer information onto a physical media 630. The print transfer apparatus 620, for example, can be an inkjet head, a laser, a piezo-electric print head, an impact print head, which can vary depending on the type of printing technology utilized. A controller 634 commands the print transfer apparatus 620 to cause the information to be transferred on to the media 630. The media pick device 610 as described herein picks the media 630 and transports it into the print area under the print transfer apparatus 620. A processor and memory module 650 can direct remote print commands to the controller 634.

The printer 600 can also include a communications module 660 for receiving print commands and updating printer status. This can also include sending remote feedback of pick events to remote locations. The communications module 660 can include local connections such as from a print cable and/or can include remote network connections such as can be received from a local network and/or over a public network such as the Internet, for example. The communications module 660 can be operated by the processor and memory module 650 which can include executable operating instructions to operate the printer 600. The processor and memory module 650 can also connect to an interface module 670 that performs interface operations to the controller 634 such as providing different print commands to the controller such as print, hold, retract, form feed, font commands, color commands, or other formatting commands, for example. As noted above, in addition to printers, media systems can include fax machines, copiers, scanners, sorters, and so forth.

What have been described above are examples. It is, of course, not possible to describe every conceivable combination of components or methodologies, but one of ordinary skill in the art will recognize that many further combinations and permutations are possible. Accordingly, the disclosure is intended to embrace all such alterations, modifications, and variations that fall within the scope of this application, including the appended claims. As used herein, the term "includes" means includes but not limited to, the term "including" means including but not limited to. The term "based on" means based at least in part on. Additionally, where the disclosure or claims recite "a," "an," "a first," or "another" element, or the equivalent thereof, it should be interpreted to include one or more than one such element, neither requiring nor excluding two or more such elements.

What is claimed is:

1. A system comprising:

a media path along which physical media travels;

a media pick device to pick and transport the media in the media path according to a pick parameter;

a device monitor to monitor a media pick event and provide a media pick event output, wherein the media pick event output identifies a media fault relating to at least one of the selection or the transport of the media; and a controller to adjust the pick parameter based on a frequency of media pick events being above a predetermined fault frequency threshold.

2. The system of claim 1, wherein the media path comprises at least one of a printer, a copier, a fax machine, or a scanner.

3. The system of claim 1, wherein the media comprises at least one of paper, plastic, polymer, synthetic material, vellum or other common medias.

4. The system of claim 1, wherein the media pick event further comprises a plurality of media pick events comprising a no-pick jam where no media is picked by the media pick device, a multi-pick jam where more than a single media is picked by the media pick device, a skew jam where media is improperly oriented by the media pick device, a wrap jam where media becomes entangled or wrapped about the rollers, an exit jam where a transport stoppage occurs at the output of the media pick device, and a late to registration jam where the media is improperly registered by the media pick device, the media pick event output specifying a type for each of plurality of media pick events detected by the device monitor.

5. The system of claim 4, wherein the controller is further to adjust the pick parameter based on the type specified for each of a plurality of media pick events.

6. The system of claim 1, wherein the controller is further to adjust the pick parameter based on a predetermined pattern of media pick events, wherein the predetermined pattern comprises an arrangement of multiple types of pick events detected to occur at a rate above a predetermined threshold set for the predetermined pattern.

7. The system of claim 1, wherein the pick parameter includes at least one of a stack lift height, a stack pressure, a pick roller stutter pattern, a pick roller pressure, a timing parameter, a torque pattern, roller material coefficients of friction, a motor parameter or a feedback parameter.

8. The system of claim 1, further comprising a communications module to communicate a message describing the media pick event output to a remote location from the media path.

9. The system of claim 1, wherein the controller further comprises a learning module to monitor the media pick event output from the device monitor over time relative to a range of conditions, the controller to adjust the pick parameter depending on a detected range of conditions identified by the learning module.

10. A method comprising:

guiding physical media along a media path according to a pick parameter, wherein the pick parameter includes at least one of a stack lift height, a stack pressure, a pick roller stutter pattern, a pick roller pressure, a timing parameter, a torque pattern, roller material coefficients of friction, a motor parameter or a feedback parameter;

monitoring media pick events generated in response to guiding the media to identify a media fault condition relating to an error in the guiding of the media;

comparing the media fault condition relative to a predetermined threshold to determine if a parameter adjustment is to be made; and adjusting the pick parameter to modify the guiding of the media if the monitored media events are detected above the predetermined threshold.

11. The method of claim 10, further comprising automatically adjusting the pick parameter based on at least one of a predetermined type or a predetermined pattern for the monitored media pick events.

12. The method of claim 10, further comprising adjusting the pick parameter based on a frequency of media pick events being above the predetermined fault threshold.

13. The method of claim 10, further comprising sending a message to a remote location to request a replacement component to adjust the pick parameter.

14. The method of claim 10, further comprising adjusting the pick parameter based on a predetermined pattern of media pick events, wherein the predetermined pattern comprises an arrangement of multiple types of pick events detected to occur at a rate above a predetermined threshold set for the predetermined pattern.

15. A method comprising:

guiding physical media along a media path according to a pick parameter;

monitoring media pick events generated from the guiding of the media;

identifying a media fault relating to the guiding of the media based on the monitoring;

sending a message based on the identified media fault exceeding a predetermined threshold associated with at least one of a frequency, a type, or a pattern of the media pick events, the message being sent to a remote location to request a replacement component to adjust the pick parameter; and adjusting the pick parameter based on at least one of installing the replacement component that is provided in response to the message and the identified media fault.

16. The method of claim 15, further comprising adjusting the pick parameter based on a frequency of media pick events being above the predetermined fault threshold.

17. The method of claim 15, further comprising adjusting the pick parameter based on a predetermined pattern of media pick events, wherein the predetermined pattern comprises an arrangement of multiple types of pick events detected to occur at a rate above a predetermined threshold set for the predetermined pattern.

18. The method of claim 15, wherein the pick parameter includes at least one of a stack lift height, a stack pressure, a pick roller stutter pattern, a pick roller pressure, a timing parameter, a torque pattern, roller material coefficients of friction, a motor parameter or a feedback parameter.

19. A system comprising:

a media path along which physical media travels;

a media pick device to pick and transport the media in the media path according to a pick parameter;

a device monitor to monitor a media pick event and provide a media pick event output, wherein the media pick event output identifies a media fault relating to at least one of the selection or the transport of the media; and a controller to adjust the pick parameter based on a predetermined pattern of media pick events, wherein the predetermined pattern of media pick events comprises an arrangement of multiple types of pick events detected, based on the media pick event output, to occur at a rate above a predetermined threshold set for the predetermined pattern of media pick events.

* * * * *